US008384635B2

(12) United States Patent
Weng

(10) Patent No.: US 8,384,635 B2
(45) Date of Patent: Feb. 26, 2013

(54) GAMMA VOLTAGE GENERATOR AND SOURCE DRIVER

(75) Inventor: Meng-Tse Weng, Sinshih Township, Tainan County (TW)

(73) Assignee: Himax Technologies Limited, Tainan County (TW)

( * ) Notice: Subject to any disclaimer, the term of this patent is extended or adjusted under 35 U.S.C. 154(b) by 410 days.

(21) Appl. No.: 12/488,983

(22) Filed: Jun. 22, 2009

(65) Prior Publication Data

US 2010/0321362 A1 Dec. 23, 2010

(51) Int. Cl.
*G09G 3/36* (2006.01)

(52) U.S. Cl. ..... 345/89

(58) Field of Classification Search ..... 345/89, 345/241, 690; 330/147
See application file for complete search history.

(56) References Cited

U.S. PATENT DOCUMENTS 7,098,733 B1 * 8/2006 Lokere ..... 330/147
7,388,592 B2 * 6/2008 Chuang et al. ..... 345/690
7,839,370 B2 * 11/2010 Izumikawa et al. ..... 345/89
2006/0022925 A1 * 2/2006 Hara et al. ..... 345/89
2007/0211005 A1 * 9/2007 Tsai ..... 345/89
2009/0009537 A1 * 1/2009 Shimatani ..... 345/690
2009/0066681 A1 * 3/2009 Kim et al. ..... 345/210
2010/0001985 A1 * 1/2010 Chen et al. ..... 345/214
2010/0207963 A1 * 8/2010 Lee et al. ..... 345/690

* cited by examiner

*Primary Examiner* — Chanh Nguyen
*Assistant Examiner* — James Nokham
(74) *Attorney, Agent, or Firm* — McClure, Qualey & Rodack, LLP

(57) ABSTRACT

A gamma voltage generator adapted in a source driver and a source driver adapted in a display panel are provided. The source driver comprises a DAC and a gamma voltage generator comprising a first and a second arithmetic circuit and a gamma voltage string. The first arithmetic circuit receives a first gamma reference voltage and at least one first tuning voltage to supply a first reference voltage. The second arithmetic circuit receives a second gamma reference voltage and at least one second tuning voltage to supply a second reference voltage. The gamma resistor string has two ends coupled to the first and the second arithmetic circuits to receive the first and the second reference voltages respectively to generate a plurality of gamma voltages. The DAC receives digital pixel data and the gamma voltages to generate a plurality of driving voltages to a pixel array of the display panel.

11 Claims, 5 Drawing Sheets

GAMMA VOLTAGE GENERATOR AND SOURCE DRIVER

BACKGROUND

1. Field of Invention

The present invention relates to a gamma voltage generator adapted in a source driver. More particularly, the present invention relates to a gamma voltage generator adapted in a source driver and a source driver adapted in a display panel.

2. Description of Related Art

A liquid crystal display (LCD) is a device that displays images by controlling transmittance of incident light emitted from a light source using optical anisotropy of liquid crystal molecules and polarization characteristics of a polarizer. Recently, the application of LCD has expanded since light-weight, slim size, high resolution and large screen size can be implemented in LCD which have low power consumption.

In general, LCD has a narrow viewing angle as compared to other display devices because light is transmitted only along a light-transmitting axis of liquid crystal molecules to display images. Some technologies form a plurality of pixels regions in a sub-pixel, driving them independently, and applying different voltages to the respective divided pixels. Thereby side-visibility can be improved, since each pixel region is charged with different levels of voltage and the light transmitting axis of the liquid crystal molecule is controlled in various directions. Therefore, a gamma voltage generator is required for generating different gamma voltages.

SUMMARY

A gamma voltage generator adapted in a source driver is provided. The gamma voltage generator comprises a first arithmetic circuit, a second arithmetic circuit and a gamma resistor string. The first arithmetic circuit is to receive a first gamma reference voltage and at least one first tuning voltage to supply a first reference voltage, wherein the first reference voltage is the arithmetic operation result of the first gamma reference voltage and the at least one tuning voltage. The second arithmetic circuit is to receive a second gamma reference voltage and at least one second tuning voltage to supply a second reference voltage, wherein the second reference voltage is the arithmetic operation result of the second gamma reference voltage and the at least one second tuning voltage. The gamma resistor string has a plurality of resistors, the two ends of the gamma resistor string are coupled to the first and the second arithmetic circuits to receive the first and the second reference voltages respectively, wherein the gamma resistor string generates a plurality of gamma voltages to a DAC of the source driver, wherein each of the plurality of gamma voltages is corresponding to a division of the difference between the first and the second reference voltages.

Another object of the present invention is to provide a source driver adapted in a display panel. The source driver comprises a gamma voltage generator and a DAC. The gamma voltage generator is to generate a plurality of gamma voltages, wherein the gamma voltage generator comprises: a first arithmetic circuit, a second arithmetic circuit and a gamma resistor string. The first arithmetic circuit is to receive a first gamma reference voltage and at least one first tuning voltage to supply a first reference voltage, wherein the first reference voltage is the arithmetic operation result of the first gamma reference voltage and the at least one tuning voltage. The second arithmetic circuit is to receive a second gamma reference voltage and at least one second tuning voltage to supply a second reference voltage, wherein the second reference voltage is the arithmetic operation result of the second gamma reference voltage and the at least one second tuning voltage. The gamma resistor string has a plurality of resistors, the two ends of the gamma resistor string are coupled to the first and the second arithmetic circuits to receive the first and the second reference voltages respectively, wherein the gamma resistor string generates a plurality of gamma voltages to a DAC of the source driver, wherein each of the plurality of gamma voltages is corresponding to a division of the difference between the first and the second reference voltages. The DAC is to receive a plurality of digital pixel data and the plurality of gamma voltages to generate a plurality of driving voltages to a pixel array of the display panel.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
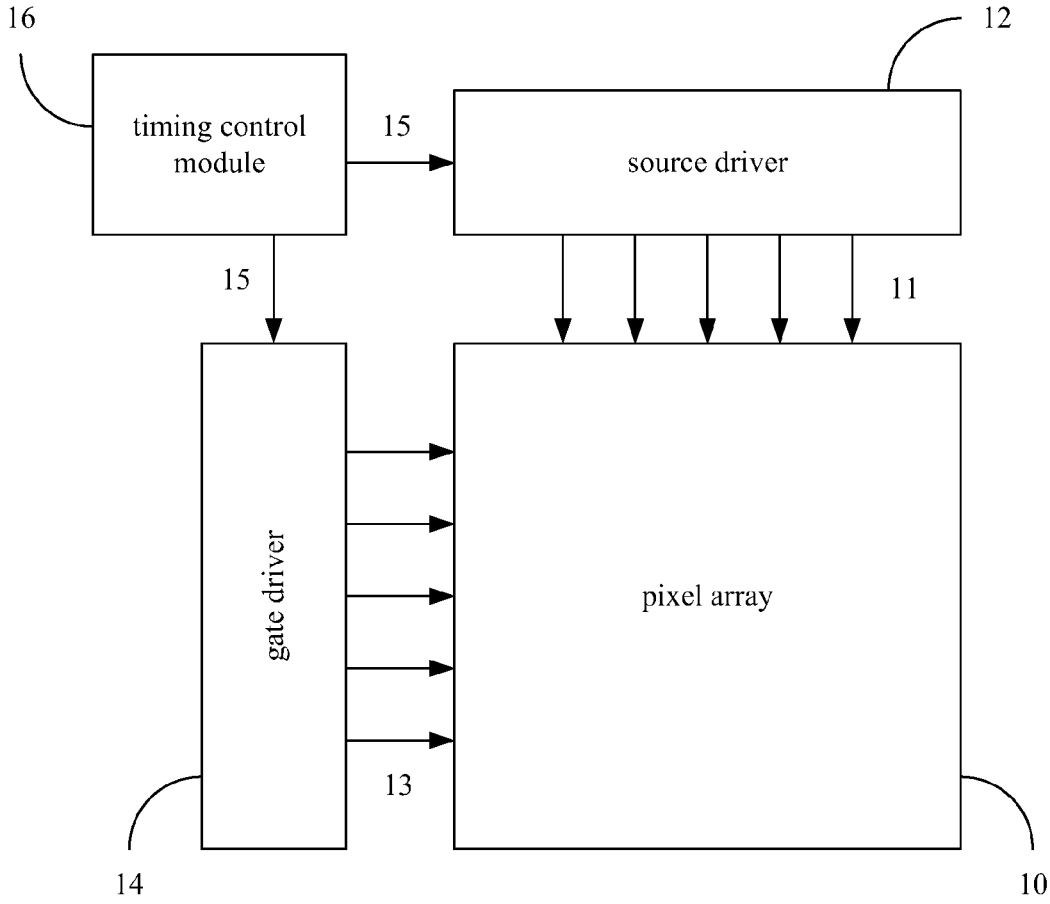
FIG. 1 is a diagram of the display panel of the first embodiment of the present invention

Reference will now be made in detail to the present embodiments of the invention, examples of which are illustrated in the accompanying drawings. Wherever possible, the same reference numbers are used in the drawings and the description to refer to the same or like parts.

Please refer to FIG. 1. FIG. 1 is a diagram of the display panel 1 of the first embodiment of the present invention. The display panel 1 comprises a pixel array 10, a source driver 12, a gate driver 14 and a timing control module 16. The pixel array 10 comprises a plurality of pixels (not shown). The source driver 12 is to send the driving voltage to the pixel array 10 through the data lines 11 to make pixel array 10 displays the image correctly according to the driving voltage 11. The gate driver 14 is to turn on the gate lines 13 on proper timing to let the source driver 12 transfer the driving voltage to the proper row of pixels. The timing control module 16 controls the timing to decide when to send the driving voltage and when to turn on the gate lines 13 through the timing control signal 15.

Figure 2:
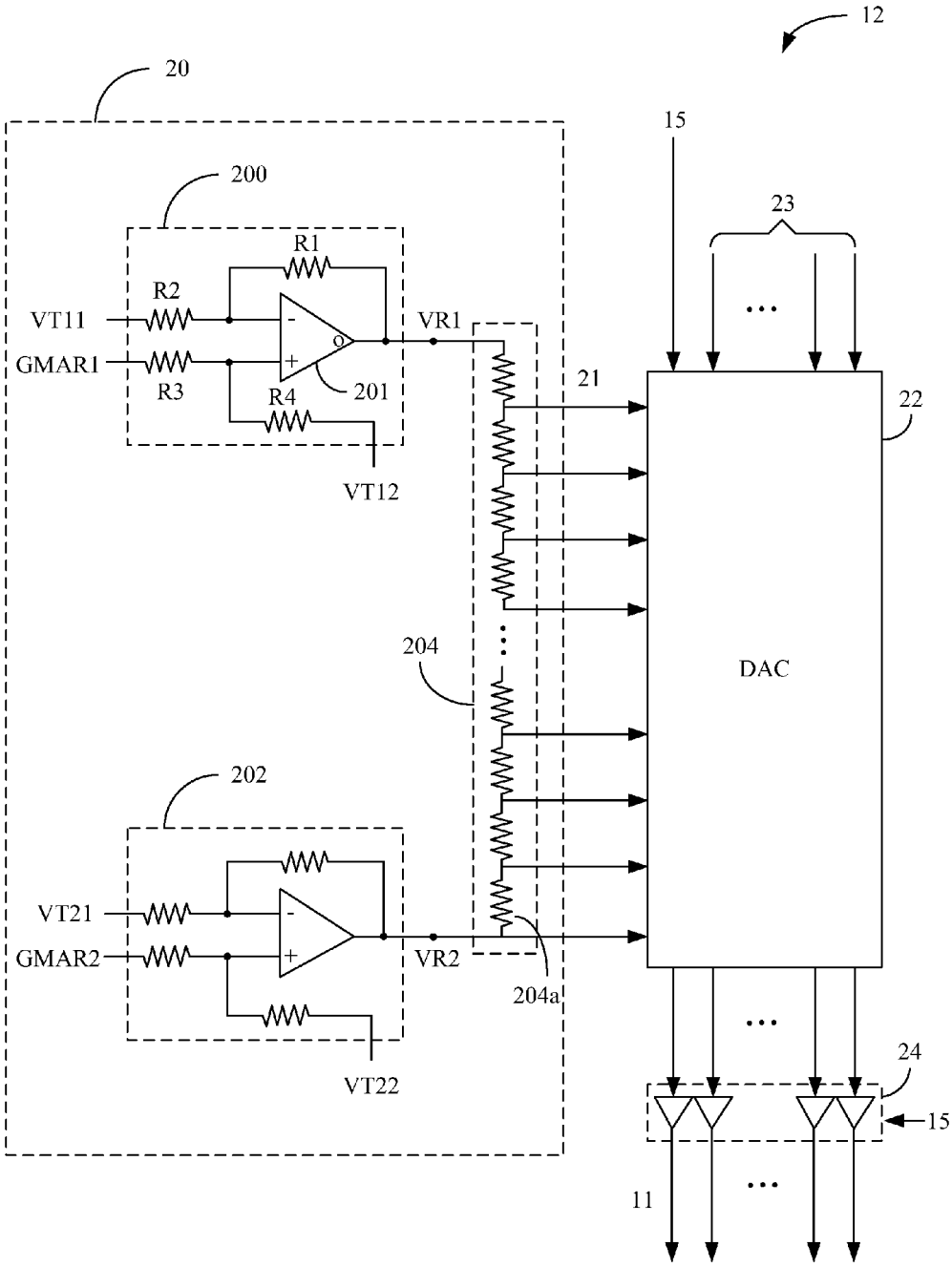
FIG. 2 is a diagram of the source driver of the first embodiment of the present invention.

Please refer to FIG. 2 at the same time. FIG. 2 is a diagram of the source driver 12 of the first embodiment of the present invention. The source driver 12 comprises a gamma voltage generator 20 and a DAC 22. The gamma voltage generator 20 is to generate a plurality of gamma voltages 21, wherein the gamma voltage generator 20 comprises: a first arithmetic circuit 200, a second arithmetic circuit 202 and a gamma resistor string 204. The first arithmetic circuit 200 in the present embodiment is to receive a first gamma reference voltage GMAR1 and two first tuning voltage VT11 and VT12 to supply a first reference voltage VR1, wherein the first reference voltage VR1 is the arithmetic operation result of the first gamma reference voltage GMAR1 and the two first tuning voltage VT11 and VT12. It's noticed that in the present embodiment, the first arithmetic circuit 200 is an operational amplifier 201 having four resistors R1, R2, R3 and R4. The resistor R1 is connected between the inverting input (−) of the operational amplifier 201 and the output (o) of the operational amplifier 201. The resistor R2 is connected to the inverting input to receive the first tuning voltage VT11. The resistor R3 is connected to the non-inverting input (+) to receive the first gamma reference voltage GMAR1. The resistor R4 is connected to the non-inverting input as well to receive the first tuning voltage VT12. Thus, the arithmetic operation result VR1 of the operational amplifier 200 is the addition and subtraction result of the first gamma reference voltage GMAR1 and the two first tuning voltage VT11 and VT12 and can be expressed as the following equation: VR1=GMAR1−VT11+VT12. Likewise, for the second arithmetic circuit 202, the second arithmetic circuit 202 in the present embodiment is to receive a second gamma reference voltage GMAR2 and two second tuning voltage VT21 and VT22 to supply a second reference voltage VR2, wherein the second reference voltage VR2 is the arithmetic operation result of the second gamma reference voltage GMAR2 and the two second tuning voltage VT21 and VT122 and can be expressed as the following equation: VR2=GMAR2−VT21+VT22.

The gamma resistor string 204 has a plurality of resistors 204*a*, the two ends of the gamma resistor string 204 are coupled to the first and the second arithmetic circuits 200 and 202 to receive the first and the second reference voltages VR1 and VR2 respectively, wherein the gamma resistor string 204 generates the plurality of gamma voltages 21, wherein each of the plurality of gamma voltages 21 is corresponding to a division of the difference between the first and the second reference voltages VR1 and VR2. The DAC 22 is to receive a plurality of digital pixel data 23 and the plurality of gamma voltages 21 to perform a gamma correction to generate a plurality of driving voltages to the data lines 11 and further to the pixel array 10 of the display panel 1 through a plurality of buffers 24. Thus, the image displayed on the display panel 1 is substantially according to the driving voltages. The timing control signal 15 substantially controls the plurality of digital pixel data 23 to determine the proper timing of the generation of the driving voltages.

It's noticed that in an embodiment, the first and the second tuning voltage VT12 and VT22 are a fixed voltage respectively, while the first and the second tuning voltage VT11 and VT21 are to receive an analog voltage which is adjusted dynamically by the timing control signal 15. Thus, the first and the second tuning voltage VT11 and VT21 can be dynamically adjusted.

Figure 3:
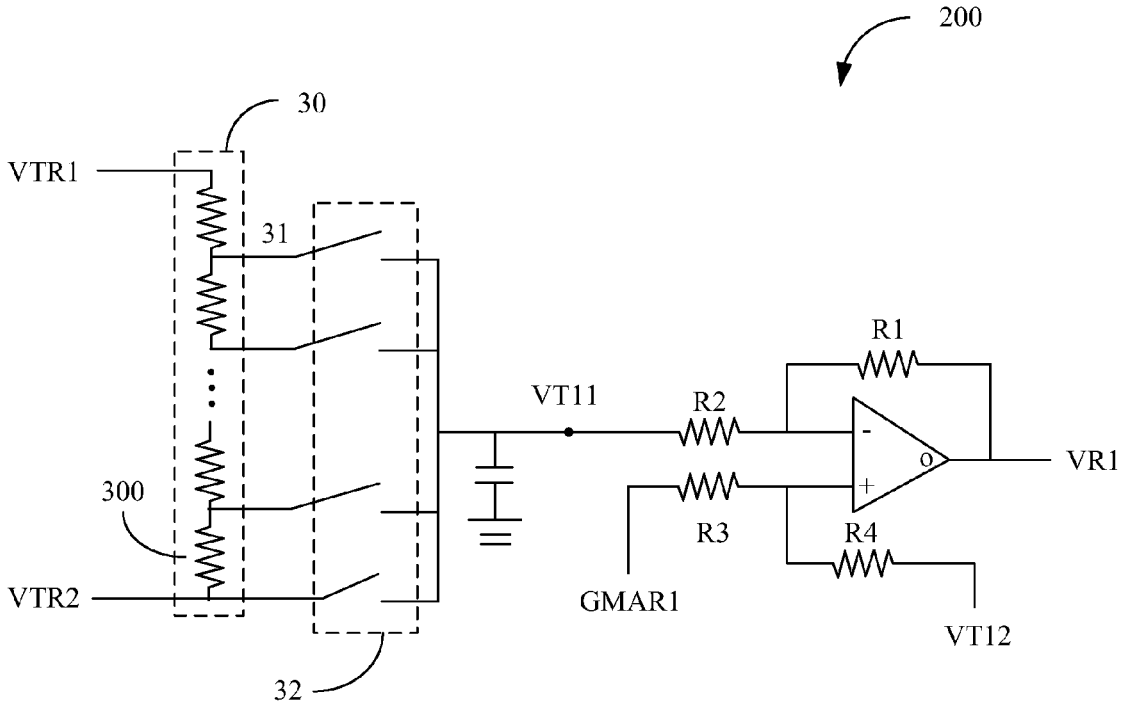
FIG. 3 is a diagram of the first arithmetic circuit in another embodiment of the present invention.

In another embodiment, the first and the second tuning voltage VT12 and VT22 are a fixed voltage respectively. Each of the first and the second arithmetic circuit 200 and 202 further comprises a tuning resistor string and a selector. Please refer to FIG. 3, a diagram of the first arithmetic circuit 200 in the present embodiment of the present invention. The first arithmetic circuit 200 further comprises a tuning resistor string 30 and a selector 32. The tuning resistor string 30 has a plurality of resistors 300, the two ends of the tuning resistor string 30 are to receive a first and a second tuning reference voltages VTR1 and VTR2 respectively, wherein the tuning resistor string 30 generates a plurality of pre-tuning voltages 31 each corresponding to a division of the difference between the first and the second tuning reference voltages VTR1 and VTR2. The selector 32 is to select at least one of the plurality of pre-tuning voltages 31 to supply the first tuning voltage VT11. In the present embodiment, the first tuning voltage VT11 is encoded into digital format and can be selected according to different conditions. The second arithmetic circuit 202 in the present embodiment has the same structure as the first arithmetic circuit 200. Thus the detail is not described here.

Figure 4:
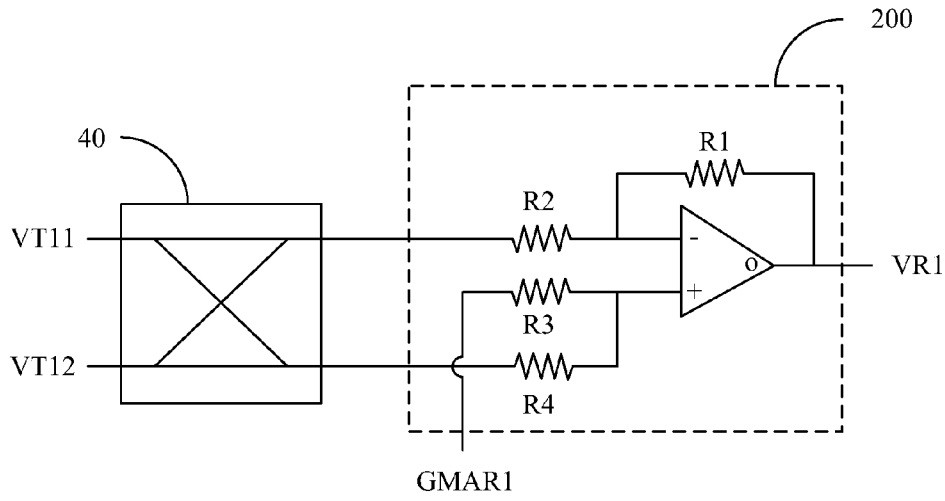
FIG. 4 is a diagram of the first arithmetic circuit in yet another embodiment of the present invention.
Figure 5:
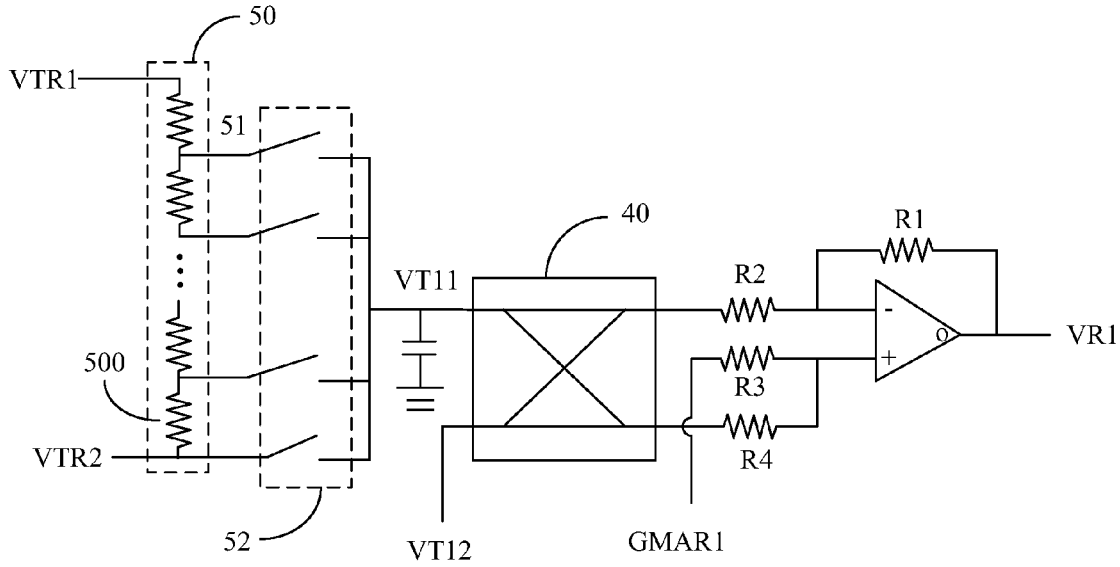
FIG. 5 is a diagram of the first arithmetic circuit in another embodiment of the present invention.

In yet another embodiment, the gamma voltage generator 20 further comprises a first multiplexer and a second multiplexer respectively. Please refer to FIG. 4, a diagram of the first arithmetic circuit 200 in the present embodiment of the present invention. The first arithmetic circuit 200 further comprises a first multiplexer 40. The first multiplexer 40 is connected between the first arithmetic circuit 200 and the first tuning voltage VT11 and VT12. The first multiplexer 40 is to select the order of arithmetic operations. According to the first multiplexer 40 in FIG. 4, the order of the arithmetic operations can be either VR1=GMAR1−VT11+VT12 or either VR1=GMAR1−VT12+VT11. Thus, the first reference voltages can be adjusted with more possibilities. In one embodiment, the VT12 can be a fixed voltage while the VT11 is to receive an analog voltage that is adjusted dynamically by the timing control signal 15. Please refer to FIG. 5, a diagram of the first arithmetic circuit 200 in another embodiment of the present invention. In the present embodiment, the first arithmetic circuit 200 further comprises a tuning resistor string 50 and a selector 52 cascaded to the first multiplexer 40. The tuning resistor string 50 has a plurality of resistors 500, the two ends of the tuning resistor string 50 are to receive a first and a second tuning reference voltages VTR1 and VTR2 respectively, wherein the tuning resistor string 50 generates a plurality of pre-tuning voltages 51 each corresponding to a division of the difference between the first and the second tuning reference voltages VTR1 and VTR2. The selector 52 is to select at least one of the plurality of pre-tuning voltages 51 to supply the first tuning voltage VT11. The present embodiment has the advantage of having the ability to encode the first tuning voltage VT11 into a digital format and to select the order of arithmetic operations of the first arithmetic circuit 200. Thus, the first tuning voltage VT11 can be properly chosen.

Figure 6:
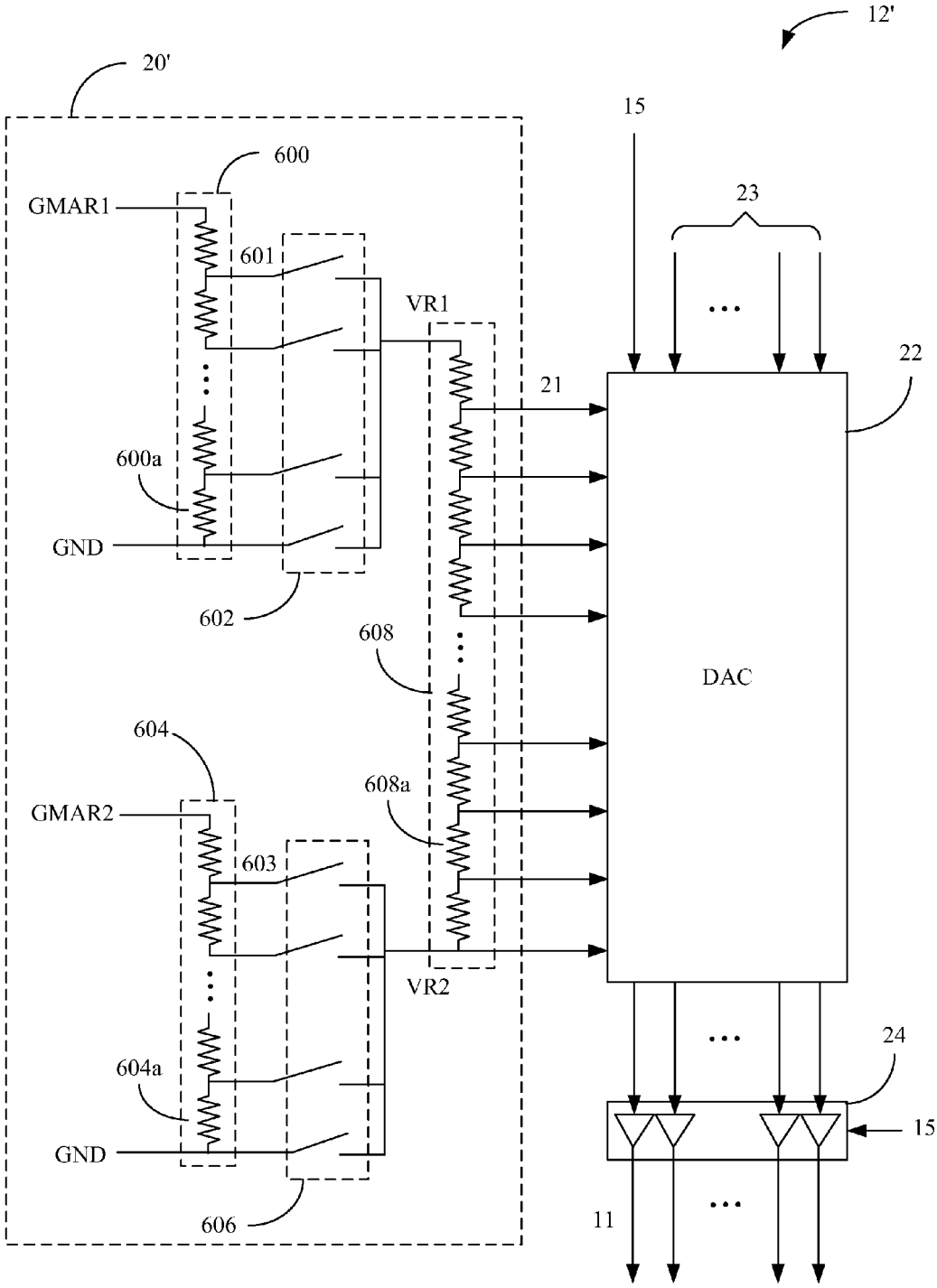
FIG. 6 is a diagram of the source driver of still another embodiment of the present invention.

FIG. 6 is a diagram of the source driver of still another embodiment of the present invention. The DAC 22 of the source driver 12' is substantially the same as the previous embodiments. However, the gamma voltage generator 20' has a slightly different architecture. The gamma voltage generator 20' in the present embodiment comprises a first reference resistor string 600, a first selector 602, a second reference resistor string 604, a second selector 606 and a gamma resistor string 608. The first reference resistor string 600 has a plurality of resistors 600*a*, one end of the first reference resistor string 600 is to receive a first gamma reference voltage GMAR1 and the other is connected to a ground GND, wherein the first reference resistor string generates a plurality of first pre-reference voltages 601 each corresponding to a division of the first gamma reference voltage GMAR1. The first selector 602 is to select at least one of the plurality of first pre-reference voltages 601 to generate a first reference voltage VR1. The second reference resistor string 604 has a plurality of resistors 604*a*, one end of the second reference resistor string 604 is to receive a second gamma reference voltage GMAR2 and the other is connected to a ground GND, wherein the second reference resistor string 604 generates a plurality of second pre-reference voltages 603 each corresponding to a division of the second gamma reference voltage GMAR2. The second selector 606 is to select at least one of the plurality of second pre-reference voltages 603 to generate a second reference voltage VR2. The gamma resistor string 608 has a plurality of resistors 608*a* and the two ends of the gamma resistor string 608 are to receive the first and the second reference voltages VR1 and VR2 respectively, wherein the gamma resistor string 608 generates a plurality of gamma voltages 21 to a DAC 22 of the source driver 12 each corresponding to a division of the difference between the first and the second reference voltages VR1 and VR2.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A gamma voltage generator adapted in a source driver, wherein the gamma voltage generator comprises:

a first arithmetic circuit to receive a first gamma reference voltage GMAR1 and two first tuning voltages VT11 and VT12 to supply a first reference voltage VR1, wherein the first arithmetic circuit is a first operational amplifier having two first inputs, in which one of the first inputs receives one of the first tuning voltages VT11 or VT12 and a feedback of the first reference voltage VR1 and the other one of the first inputs receives the first gamma reference voltage GMAR1 and the other one of the first tuning voltages VT11 or VT12, the first reference voltage VR1 is the arithmetic operation result of the first gamma reference voltage GMAR1 and the first tuning voltages VT11 and VT12;

a first multiplexer connected between the first arithmetic circuit and the first tuning voltages to select the order of the two first tuning voltages in arithmetic operations such that the arithmetic operation result is either VR1=GMAR1−VT11+VT12 or VR1=GMAR1−VT12+VT11;

a second arithmetic circuit to receive a second gamma reference voltage GMAR2 and two second tuning voltages VT21 and VT22 to supply a second reference voltage VR2, wherein the second arithmetic circuit is a second operational amplifier having two second inputs, in which one of the second inputs receives one of the second tuning voltages VT21 or VT22 and a feedback of the second reference voltage VR2 and the other one of the second inputs receives the second gamma reference voltage GMAR2 and the other one of the second tuning voltages VT21 or VT22, the second reference voltage VR2 is the arithmetic operation result of the second gamma reference voltage GMAR2 and the second tuning voltages VT21 and VT22;

a second multiplexer connected between the second arithmetic circuit and the second tuning voltages to select the order of the two second tuning voltages in arithmetic operations such that the arithmetic operation result is either VR2=GMAR2−VT21+VT22 or VR2=GMAR2−VT22+VT21; and a gamma resistor string having a plurality of resistors, the two ends of the gamma resistor string are coupled to the first and the second arithmetic circuits to receive the first reference voltage VR1 and the second reference voltages VR2 respectively, wherein the gamma resistor string generates a plurality of gamma voltages to a DAC of the source driver, wherein each of the plurality of gamma voltages is corresponding to a division of the difference between the first reference voltage VR1 and the second reference voltages VR2.

2. The gamma voltage generator of claim 1, wherein the arithmetic operation result is the addition and subtraction result of the first gamma reference voltage and the first tuning voltages.

3. The gamma voltage generator of claim 1, wherein each of the first tuning voltages is substantially an analog voltage dynamically adjusted by a timing control signal.

4. The gamma voltage generator of claim 1, wherein the first and the second multiplexer substantially receive an analog voltage respectively to select the order of the arithmetic operations, wherein the analog voltage is dynamically adjusted by a timing control signal.

5. The gamma voltage generator of claim 1, wherein each of the first and the second arithmetic circuit further comprises:

a tuning resistor string having a plurality of resistors, the two ends of the tuning resistor string are to receive a first and a second tuning reference voltages respectively, wherein the tuning resistor string generates a plurality of pre-tuning voltages each corresponding to a division of the difference between the first and the second tuning reference voltages; and a selector to select at least one of the plurality of pre-tuning voltages to supply the first tuning voltages or the second tuning voltages.

6. A source driver adapted in a display panel comprising:

a gamma voltage generator to generate a plurality of gamma voltages, wherein the gamma voltage generator comprises:

a first arithmetic circuit to receive a first gamma reference voltage GMAR1 and two first tuning voltages VT11 and VT12 to supply a first reference voltage VR1, wherein the first arithmetic circuit is a first operational amplifier having two first inputs, in which one of the first inputs receives one of the first tuning voltages VT11 or VT12 and a feedback of the first reference voltage VR1 and the other one of the first inputs receives the first gamma reference voltage GMAR1 and the other one of the first tuning voltages VT11 or VT12, the first reference voltage VR1 is the arithmetic operation result of the first gamma reference voltage GMAR1 and the first tuning voltages VT11 and VT12;

a first multiplexer connected between the first arithmetic circuit and the first tuning voltages to select the order of the two first tuning voltages in arithmetic operations such that the arithmetic operation result is either VR1=GMAR1−VT11+VT12 or VR1=GMAR1−VT12+VT11;

a second arithmetic circuit to receive a second gamma reference voltage GMAR2 and two second tuning voltages VT21 and VT22 to supply a second reference voltage VR2, wherein the second arithmetic circuit is a second operational amplifier having two second inputs, in which one of the second inputs receives one of the second tuning voltages VT21 or VT22 and a feedback of the second reference voltage VR2 and the other one of the second inputs receives the second gamma reference voltage GMAR2 and the other one of the second tuning voltages VT21 or VT22, the second reference voltage is the arithmetic operation result of the second gamma reference voltage GMAR2 and the second tuning voltages VT21 and VT22;

a second multiplexer connected between the second arithmetic circuit and the second tuning voltages to select the order of the two second tuning voltages in arithmetic operations such that the arithmetic operation result is either VR2=GMAR2−VT21+VT22 or VR2=GMAR2−VT22+VT21; and a gamma resistor string having a plurality of resistors, the two ends of the gamma resistor string are coupled to the first and the second arithmetic circuits to receive the first reference voltage VR1 and the second reference voltages VR2 respectively, wherein the gamma resistor string generates the plurality of gamma voltages, wherein each of the plurality of gamma voltages is corresponding to a division of the difference between the first reference voltage VR1 and the second reference voltages VR2; and a DAC to receive a plurality of digital pixel data and the plurality of gamma voltages to generate a plurality of driving voltages to a pixel array of the display panel.

7. The source driver of claim 6, wherein the arithmetic operation result is the addition and subtraction result of the first gamma reference voltage and the first tuning voltages.

8. The source driver of claim 6, wherein each of the first tuning voltages is substantially an analog voltage dynamically adjusted by a timing control signal.

9. The source driver of claim 6, wherein the first and the second multiplexer substantially receive an analog voltage respectively to select the order of the arithmetic operations, wherein the analog voltage is dynamically adjusted by a timing control signal.

10. The source driver of claim 6, wherein each of the first and the second arithmetic circuit further comprises:

a tuning resistor string having a plurality of resistors, the two ends of the tuning resistor string are to receive a first and a second tuning reference voltages respectively, wherein the tuning resistor string generates a plurality of pre-tuning voltages each corresponding to a division of the difference between the first and the second tuning reference voltages; and a selector to select at least one of the plurality of pre-tuning voltages to supply the first tuning voltages or the second tuning voltages.

11. The source driver of claim 6, further comprising a plurality of operational amplifier to reinforce the driving ability of the plurality of driving voltages.

* * * * *